US007484929B1

(12) United States Patent
Fitzpatrick

(10) Patent No.: US 7,484,929 B1
(45) Date of Patent: Feb. 3, 2009

(54) EXHAUST FAN SYSTEMS

(75) Inventor: Erich R. Fitzpatrick, Strafford, MO (US)

(73) Assignee: Loren Cook Company, Springfield, MO (US)

( * ) Notice: Subject to any disclaimer, the term of this patent is extended or adjusted under 35 U.S.C. 154(b) by 502 days.

(21) Appl. No.: 11/178,795

(22) Filed: Jul. 11, 2005

Related U.S. Application Data

(60) Provisional application No. 60/586,760, filed on Jul. 9, 2004.

(51) Int. Cl.
*F04D 29/54* (2006.01)

(52) U.S. Cl. ..... 415/116; 415/77; 415/211.2; 415/218.1; 415/219.1; 415/220; 415/222; 415/223; 416/175; 416/203; 416/193 R; 454/8; 454/11; 454/15; 454/41; 454/42

(58) Field of Classification Search ..... 415/77–79, 415/116, 211.2, 218.1, 219.1, 220–223; 416/175, 416/179, 189, 193 R, 203; 454/8, 11, 15, 454/41, 42; 52/198, 199
See application file for complete search history.

(56) References Cited

U.S. PATENT DOCUMENTS

| | | | | |
|---|---|---|---|---|
| 2,322,302 | A * | 6/1943 | Martinson | 454/356 |
| 2,571,513 | A * | 10/1951 | Ammerman | 415/223 |
| 3,143,283 | A * | 8/1964 | Downs | 415/77 |
| 3,282,053 | A * | 11/1966 | Messerschmitt | 416/193 R |
| 3,561,883 | A * | 2/1971 | Berry | 415/218.1 |
| 3,811,791 | A * | 5/1974 | Cotton | 416/193 R |
| 3,837,269 | A | 9/1974 | Sweet et al. | |
| 4,086,043 | A | 4/1978 | Howe | |
| 4,363,642 | A | 12/1982 | Stahl | |
| 4,806,076 | A | 2/1989 | Andrews | |
| 4,846,261 | A * | 7/1989 | Kittila | 416/193 R |
| 5,203,164 | A * | 4/1993 | Paulson | 60/226.1 |
| 5,439,349 | A | 8/1995 | Kupfenberg | |
| 5,809,993 | A | 9/1998 | Nietzel et al. | |
| 6,050,258 | A | 4/2000 | Nietzel et al. | |
| 2003/0206800 | A1 * | 11/2003 | Mathson et al. | 415/220 |

FOREIGN PATENT DOCUMENTS

| | | | | |
|---|---|---|---|---|
| IT | 521551 | A * | 3/1955 | 416/193 R |

OTHER PUBLICATIONS

"Facilities Manager" magazine. May/Jun. issue. vol. 17, No. 3 (6 sheets).

(Continued)

*Primary Examiner*—Christopher Verdier
(74) *Attorney, Agent, or Firm*—Jonathan A. Bay

(57) ABSTRACT

Exhaust apparatus for exhausting "dirty" exhaust gases accept a core flow of such exhaust gases and combine that with an annularly-surrounding "rooftop" flow of ambient air for diluting the exhaust gases as well as expelling the diluted flow in a forcibly expelled plume in order to ensure that the "effective" expulsion distance of the expelled diluted flow is at least the physical length of the exhaust apparatus plus the gains gotten from efflux velocity and flowrate.

12 Claims, 9 Drawing Sheets

OTHER PUBLICATIONS

Product description of Vent-Axia® Mixed Flow Roof Fan (RMH), from product catalog of Vent-Axia® LLC. London. UK. pp. 318-325. (no date).
Product description of Vent-Axia® Mixed Flow Roof Fan (RMH), from web site of Vent-Axia® LLC. London. UK. www.vent-axia.com/awwebstore/products/industrial/rmh.asp (no date).
Product description of Vent-Axia® Mixed Flow Roof Fan (RMV), from product catalog of Vent-Axia® LLC. London. UK. pp. 364-371. (no date).
Product description of Vent-Axia® Mixed Flow Roof Fan (RMV), from website of Vent-Axia® LLC. London. UK. www.vent-axia.com/awwebstore/products/industrial/rmv.asp (no date)

* cited by examiner

EXHAUST FAN SYSTEMS

CROSS-REFERENCE TO PROVISIONAL APPLICATION(S)

This application claims the benefit of U.S. Provisional Application No. 60/586,760, filed Jul. 9, 2004, which disclosure is incorporated by this reference thereto.

BACKGROUND AND SUMMARY OF THE INVENTION

The invention relates to exhaust fans for exhausting "dirty" or "lab" air (more generically, "inlet" air) and, more particularly, to exhaust fans which mix the inlet air flow with an induced air flow (sometimes otherwise referred to as "dilution" or "rooftop" air).

As a matter of background, exhaust emissions have long been provided with exhaust stacks in order to ensure that the "effective" stack height of the emissions is at least the physical stack height. However, "effective" stack height is more accurately the sum of the physical stack height plus the gains gotten from other effects such as efflux velocity and flowrate, or in other cases buoyancy, and so on. Looked at another way, "effective" stack height is the point where (ignoring buoyancy) the contributions end from such other effects as efflux velocity and flowrate. At that point, the emissions are at the mercy of the dispersions of the localized ambient.

It is an object of the invention to provide exhaust fan systems which minimize physical stack height but through other design factors maximize effective stack height.

It is an alternative object of the invention to achieve the foregoing in combination with mixing an induced or dilution air flow with the given inlet (eg., "dirty" or "lab") air flow such that the efflux comprises a mixed flow.

It is an additional object of the invention to provide the foregoing with dual driven-impeller packages such that they operate as counterparts to each other. That is, one impeller is optimized for suctioning out the inlet flow from a converging network of ducts having origins in remote diverse intake ports. In contrast, the other impeller is optimized for expelling the mixed exhaust in a tall, columnar plume.

These and other aspects and objects of the invention are provided by an exhaust apparatus for diluting a forced, primary flow of gases with a secondary flow and expelling the consequential diluted flow. One embodiment of such an apparatus comprises the following. That is, it has a passageway for delivering the forced, primary flow. The passageway terminates in an outlet port therefor.

There is also a center body that axially extends from the outlet port to a spaced terminal end. The center body is radially contoured in the axial direction from the outlet port toward the terminal end to include a flaring portion, a convex transition portion, and then a tapering portion. The center body is positioned with respect to the outlet port to accept the delivery of the primary flow to outflow therefrom and be flared out by traversing along the flaring portion.

There is furthermore a windband or, in alternative terminology, a collar. Such a collar axially extends between an input end and a spaced output end. The collar is radially sized to surround the center body and define an annular flow passage therewith. The collar furthermore includes an intermediate hoop section that is sized and disposed to define an annular throat in combination with the center body's convex transition portion.

Given the foregoing, the collar being disposed such that the input end is aimed to channel the outflow of the primary flow from the outlet port toward said throat. Additionally, the collar's input end is spaced away from the passageway's outlet port to allow the introduction of the secondary flow to the primary flow such that the consequential diluted flow flows through said throat and is expelled out the output end.

The invention might more particularly be situated in an environment whereby the passageway comprises an exhaust stack. Such an exhaust stack extends into ambient air and therefore the collar might be reckoned as shaped in a funnel form. That is, from a reference of the hoop section, the funnel form generally flares out toward the input end as well as tapers in toward the output end. In this context, the secondary flow generally comprises drawn in ambient air.

The invention might further be conceived of as including a driven fan downstream from the outlet port for forcing the primary flow. In this context, the primary flow can be reckoned as exhaust gases which are pre-selected to be diluted by ambient air.

In the context of the passageway comprising an exhaust stack, the center body might optionally include a circumferential seam below the convex transition portion for draining adhering rainwater into an interior well. Moreover, the collar might be advantageously shaped to taper toward the output end in spaced correspondence with the center body's tapering portion in order to define an annular nozzle passage sized to forcibly expel the diluted flow.

An alternate embodiment of such an exhaust apparatus operates to combine a forced, first flow of gases with a second flow, thereafter forcibly expel the consequential combined flow. Such an apparatus includes an inventive impeller wheel for forcing the second flow in a direction from a suction side to a pressure side.

Such an impeller wheel includes a hub for rotation about a spin axis, a coaxial rim annularly spaced from the hub and axially extending between a pressure-side edge and a suction-side edge, apertured webbing radially spacing and interconnecting the hub and rim, and angularly spaced blades extending radially out from the rim to tip edges.

A like passageway as described previously is provided for delivering the forced, first flow. Such a passageway terminates in an outlet port, which is disposed to match up closely with the rim's suction-side edge for channeling the forced, first flow to pass through the apertured webbing from the suction side to the pressure side.

Given the foregoing, the blades of the spinning impeller wheel axially force the second flow to annularly wrap around a core of the forced, first flow and thereby afford the flows to combine into the combined flow on the pressure side of the impeller wheel.

This alternate embodiment of an exhaust stack apparatus might optionally include a windband as well, or in alternate terminology, a shroud. Such a shroud would preferably have a circumferential sidewall axially extending between an input end and a spaced output end. It would also preferably have a hoop section that is axially-spaced from the output end. More preferred still is if this particular hoop section is radially-sized and positioned to closely surround a periphery of the tip edges of impeller wheel blades. Overall, the shroud should be positioned such that the input end channels a supply of the second flow toward the impeller blades from the suction side. In consequence, the output end will expel the consequential combined flow.

This alternate embodiment of an exhaust stack apparatus might further be designed as a package including a driven fan downstream from the impeller wheel for forcing the first flow. That way, if the drive for the impeller wheel is adjustable for expelling the diluted flow, then driven fan might be independently adjustable for the loads it is designed to carry in suctioning out exhaust gases from a building or the like.

It is an aspect of the invention that the aforementioned apertured webbing might be realized in any of a variety of designs, including without limitation being designed as angularly-distributed spokes.

A number of additional features and objects will be apparent in connection with the following discussion of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
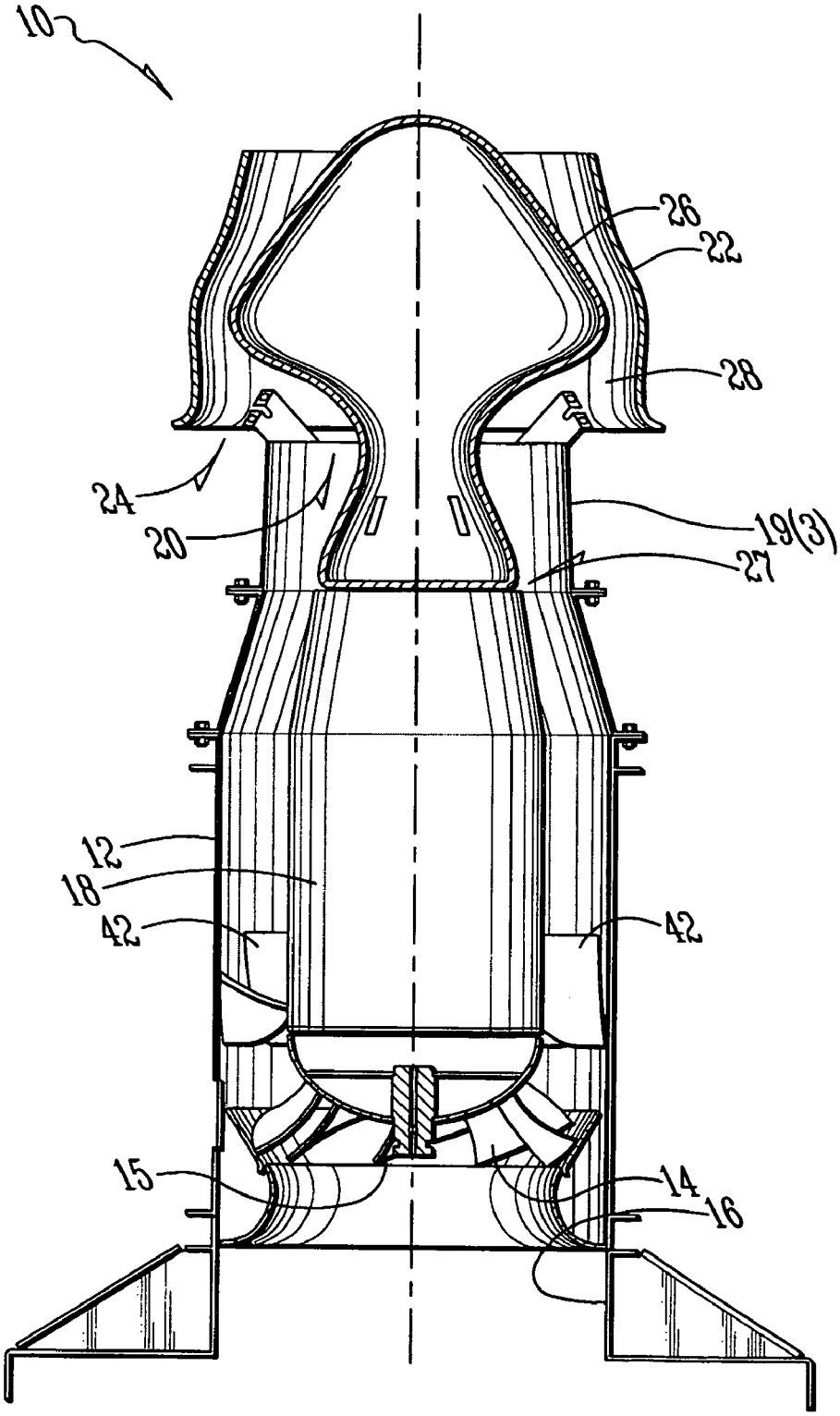
FIG. 1 is a partial sectional view of an exhaust stack system in accordance with the invention, taken along line I-I in FIG. 4.
Figure 2A:
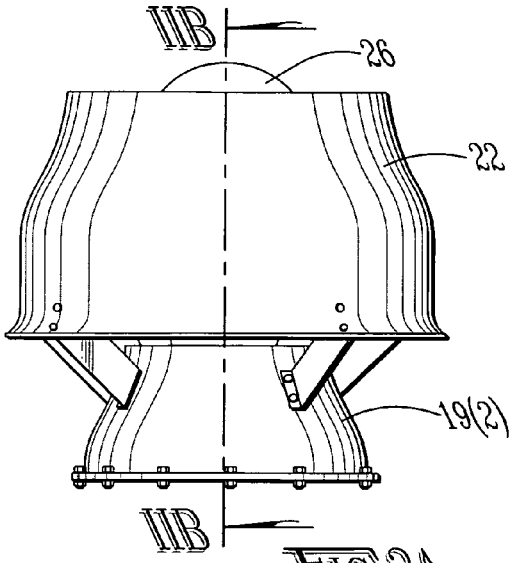
FIG. 2*a* is a side elevational view of the windband, center bulb and one version of the lower outer housing of FIG. 1.
Figure 2B:
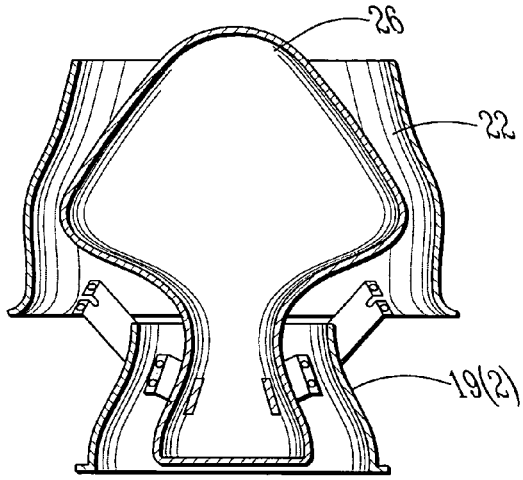
FIG. 2*b* is a sectional view taken along line IIB-IIB in FIG. 2*a;*
Figure 3A:
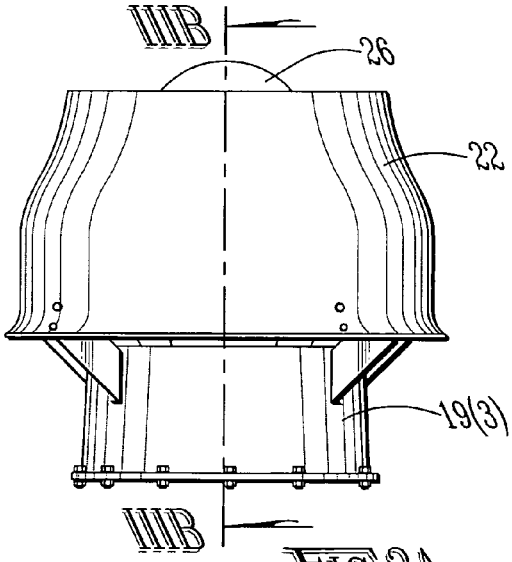
FIG. 3*a* is a side elevational view of the windband, center bulb and an alternate version of the lower outer housing of FIG. 1.
Figure 3B:
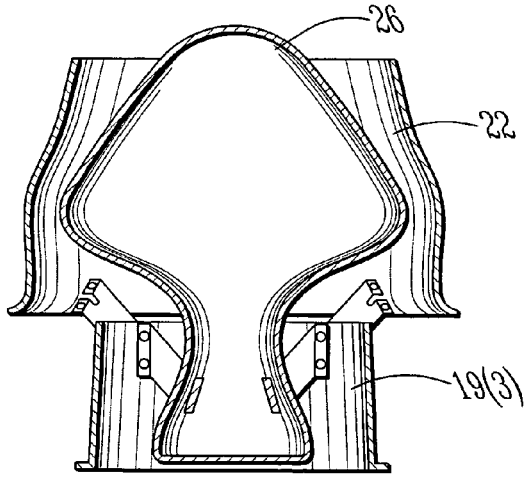
FIG. 3*b* is a sectional view taken along line IIIB-IIIB in FIG. 3*a;*
Figure 4:
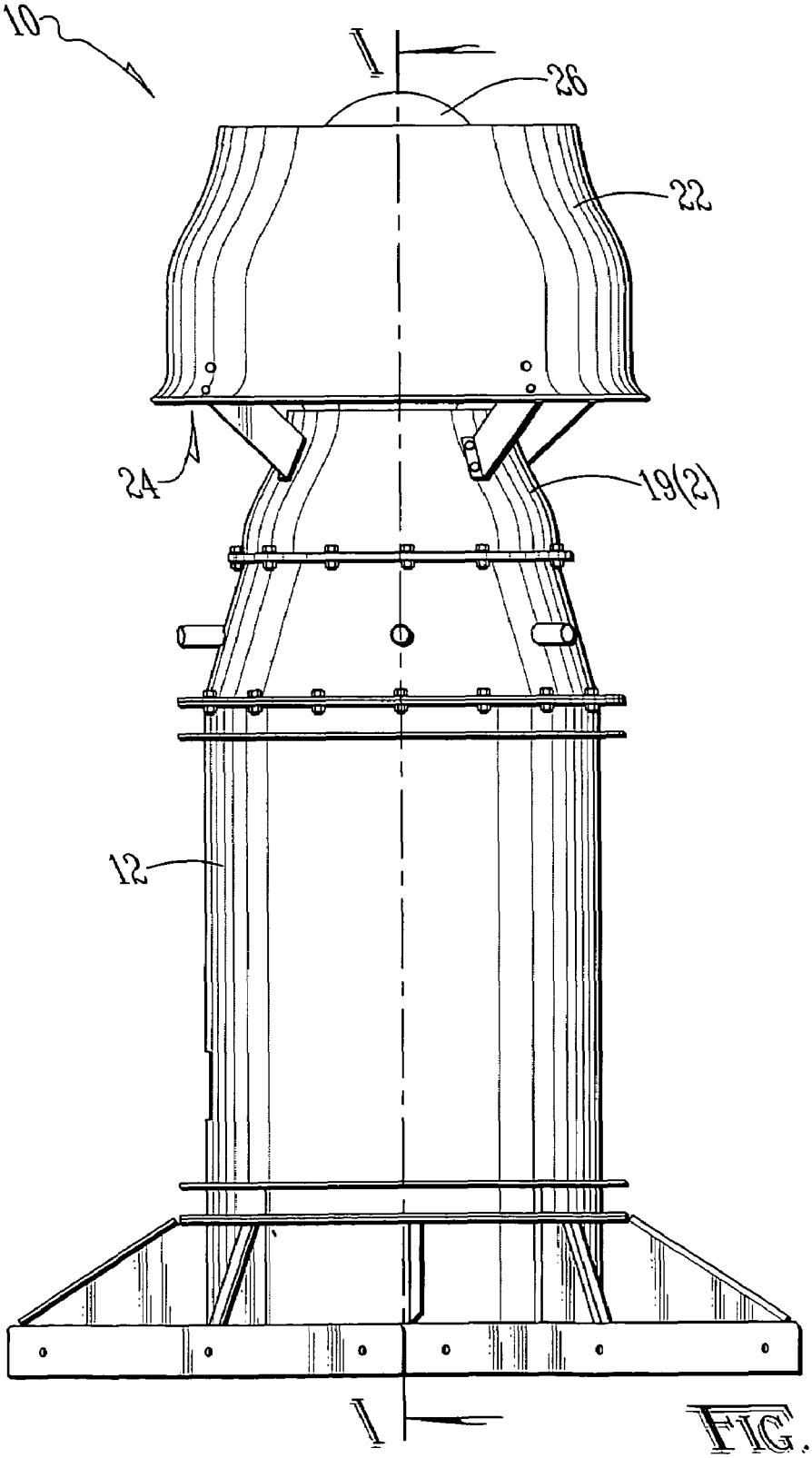
FIG. 4 is a side elevational view of FIG. 1.

FIGS. 1 through 5 shows a first embodiment of an exhaust stack system 10 in accordance with the invention. It comprises an intake duct 12 to situate directly on top of the upper terminus of an inlet-air blower 14. The inlet-air blower 14 operates in part to suction out the inlet flow from a converging terminus 16 of a network of ducts (not shown) having origins in remote diverse intake ports (not shown). It is an aspect of the invention to draw in a dilution air flow to mix with the inlet air flow and then thereafter expel the mix in a tall, columnar plume by a relatively compact stack so that the effective height of the stack far exceeds the comparatively diminutive, physical height of the stack. This aspect is achieved in part by the following.

There is a center (inner) tapered housing 18 surrounded by a companion outer housing 19(2) or 19(3). The outer housing 19(2) or 19(3) terminates in an upper end which defines a (lower) exhaust port 20 for the inlet flow. FIG. 1 shows one version of the outer housing 19(3). This version of the outer housing 19(3) is shown better by FIGS. 3*a* and 3*b*. This version of the outer housing 19(3) is designed for high efficiency operation, in contrast to high discharge velocity operation. An alternate version of the outer housing 19(2) is shown better by FIGS. 2*a* and 2*b*. This version of the outer housing 19(2) is designed for high discharge velocity operation, in contrast to high efficiency operation. That is, the high discharge velocity version of the outer housing 19(2) defines a relatively more constricted exhaust port 20 than the high efficiency version of the outer housing 19(3). Hence the high discharge velocity version of the outer housing 19(2) with its relatively more constricted exhaust port 20 makes the fan motor 15 work harder than the high efficiency version of the outer housing 19(3).

With either version of the outer housing 19(2) or 19(3), the air inlet flow is discharged through the exhaust port 20 into a windband 22. Again, the upper termination of the outer housing 19(2) or 19(3) defines the elevation of the (lower) exhaust port 20.

In contrast, the center (inner) housing 18 extends above the elevation of the (lower) exhaust port 20. From this elevation and above, the center (inner) housing 18 is more particularly referenced as a center bulb 26. The center bulb 26 very approximately resembles a toadstool cap. The windband 22 has an open lower skirt portion 24 for dragging in a dilution (or "rooftop") air flow. The windband 22 extends upwardly and surrounding the center bulb 26. The windband 22 and center bulb 26 are cooperatively shaped and arranged to form an upper venturi throat 28, which is designed to expel the mix of inlet and dilution air in a tall, columnar plume.

The center (inner) housing 18 has an intermediate partition 27. This intermediate partition 27 functions in part as a rainwater gutter. Rainwater landing on top of the center bulb 26 is blocked from dripping directly down onto the inlet-air blower 14. Instead, the rainwater dribbles down the sidewall of the center bulb 26 as well as continuing down where the center bulb transitions into the center (inner) housing 18 due to the property of surface adhesion or the like. Whenever the dribbling rainwater reaches the level of the intermediate partition 27, the dribbling rainwater continues to follow the contour until it drips off into a well (the well is not illustrated) for the drip-off that is provided inside the center (inner) housing 18. The well is sized to catch the rainfall during rainy periods. The well has a drainpipe (now shown) for draining the caught rainfall out onto the rooftop.

Figure 5:
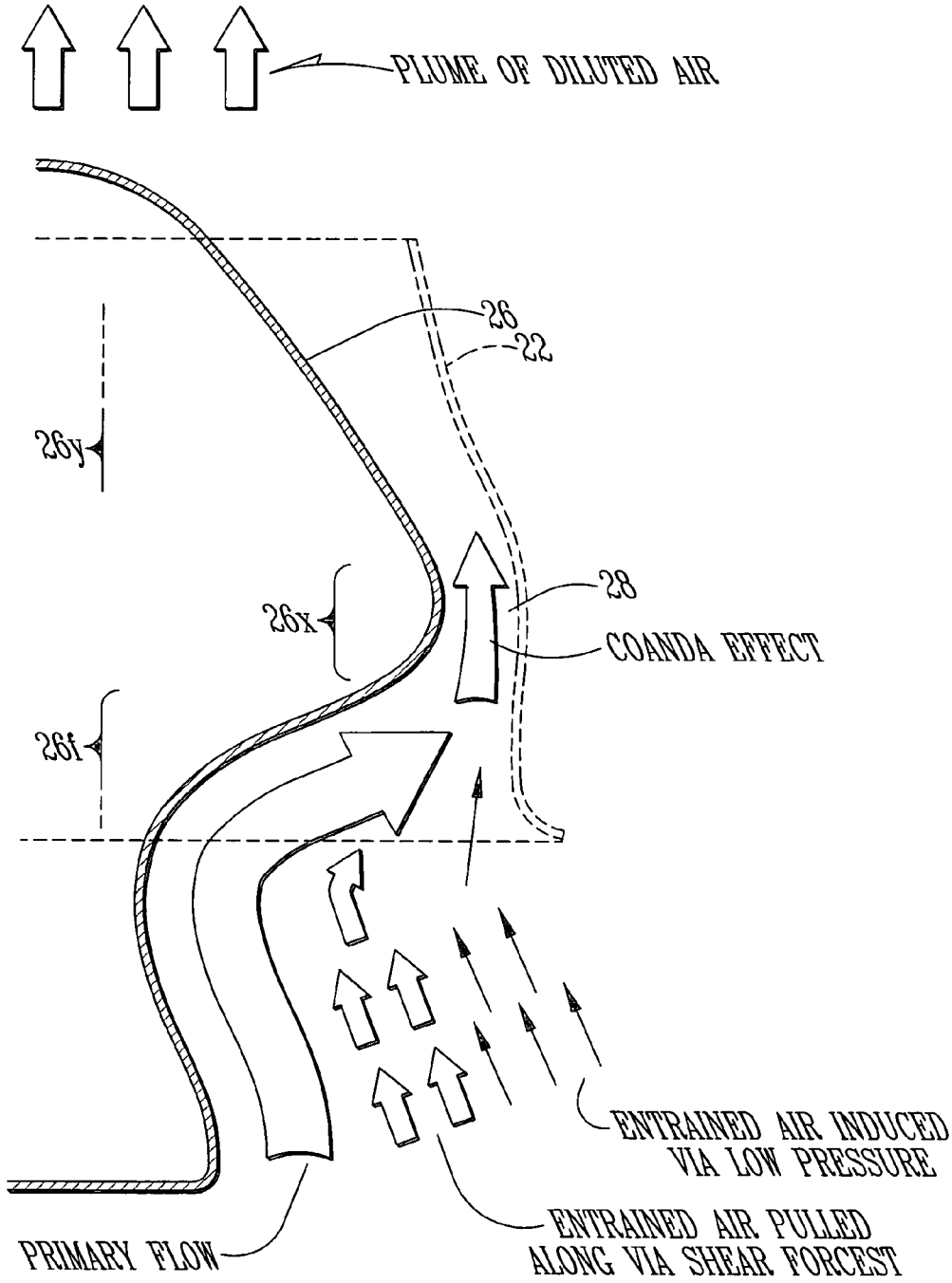
FIG. 5 is an enlarged sectional detail taken from FIG. 1 of the center bulb and windband to show the dilution of the primary flow with the induced flow of rooftop air and show the consequent production of a plume of the diluted flow.

FIG. 5 shows the physical factors involved which force the dilution of the primary flow with the induced flow of rooftop air and thereby obtain the consequent production of a plume of the diluted flow.

The center bulb 26 extends axially from the exhaust port 20 to the center bulb 26's terminal cap with a contour as follows. That is, the center bulb 26 has a flaring portion 26*f* that changes into a convex transition portion 26*x* that then changes into a tapering portion 26*y*. The lower exhaust port (eg., 20, but not shown in FIG. 5) delivers the primary flow to outflow therefrom and be flared out by traversing along the flaring portion 26*f*. Rooftop air is induced to flow through the throat 28 by various forces. For streams of the rooftop air in closest proximity with the primary flow, these streams are dragged along by shear forces. Other streams of rooftop air are suctioned in by a low pressure belt created around the waist of the flaring portion 26*f*. Together these streams of rooftop air along with the primary air flow through the venturi throat 28 and mass together likely because of both a venturi effect and a Coanda effect.

Briefly, the venturi effect describes the case of a flow flowing through a constriction (ie., the throat 28). The flow speeds up in the restriction, producing a reduction in pressure and a partial vacuum. One way to visualize the venturi effect is to squeeze a (very) flexible garden hose carrying water. If the flow is strong enough, the constriction will remain in the hose even if the hose would normally spring back to its normal shape:—the partial vacuum produced in the constriction is sufficient to keep the hose collapsed. The Coanda effect, on the other hand, is the tendency of a flow to stay attached to a convex surface rather than follow a straight line in its original direction.

The combination of the venturi effect and Coanda effect can be visualized as follows. The back of a spoon can be held close to (but not touching) a stream of water running freely out of a tap (faucet), and it will be discovered that the stream of water will deflect from vertical, attach to the spoon and thereafter run over the back of the spoon. In this example, the venturi effect explains that a drop in pressure between the spoon and the stream causes the stream to deflect towards the spoon. The Coanda effect explains that, once the stream hits the back of the spoon, the stream keeps running over the convex surface of the back of the spoon.

Hence in FIG. 5, the primary flow drags one stream of rooftop air because of shear forces. As the primary flow swells out along the flaring section 26*f*, it accelerates. Such acceleration amplifies the venturi effect, which suctions in more rooftop air because of the venturi effect. Once the combined flows of the primary air and the streams of rooftop air traverse the convex transition portion 26*x*, the Coanda effect takes over and tends to cause the adherence of the combined flows along the surface of the center bulb 26.

Figure 6:
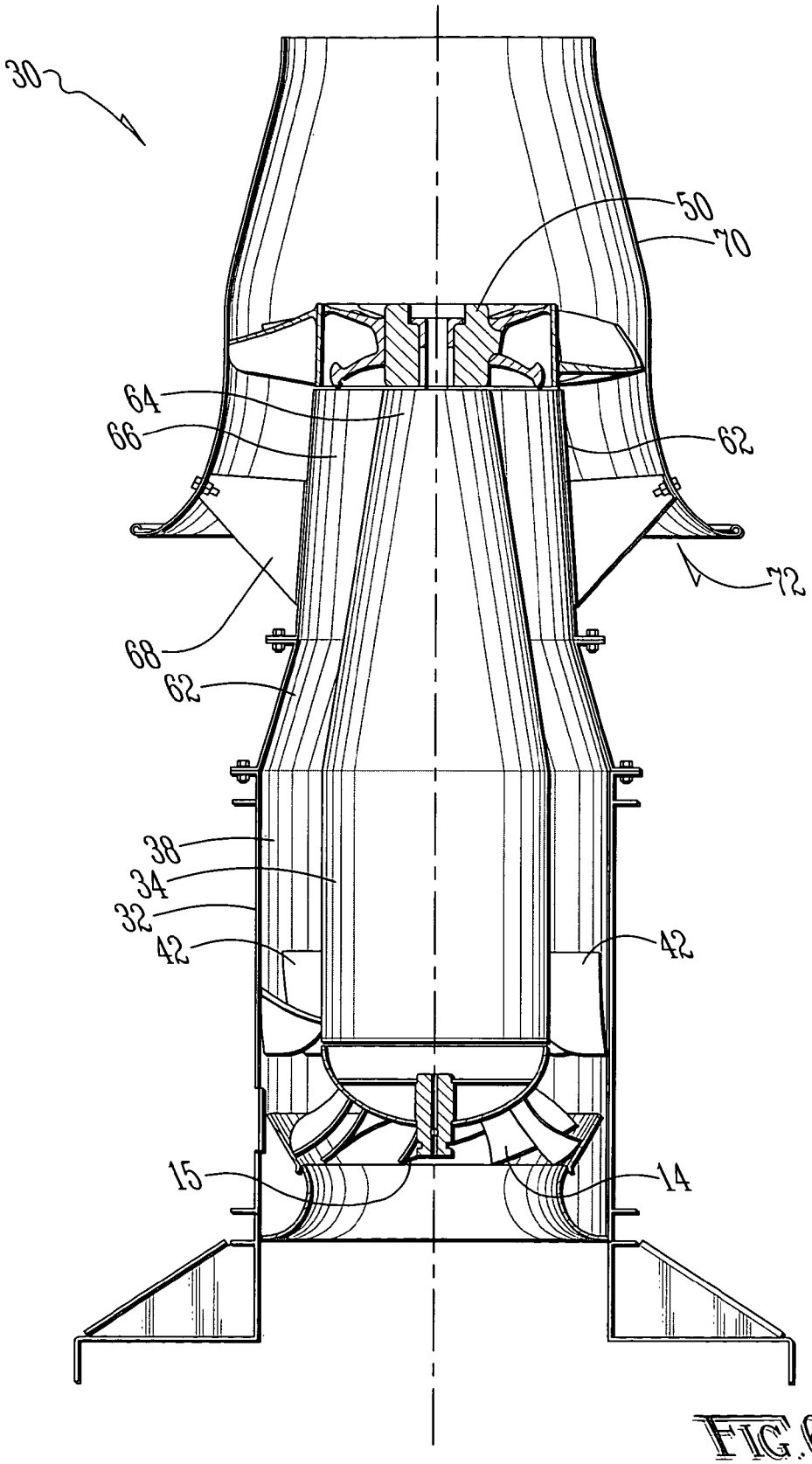
FIG. 6 is partial sectional view comparable to FIG. 1 except showing an alternate embodiment of an exhaust stack system in accordance with the invention.
Figure 7:
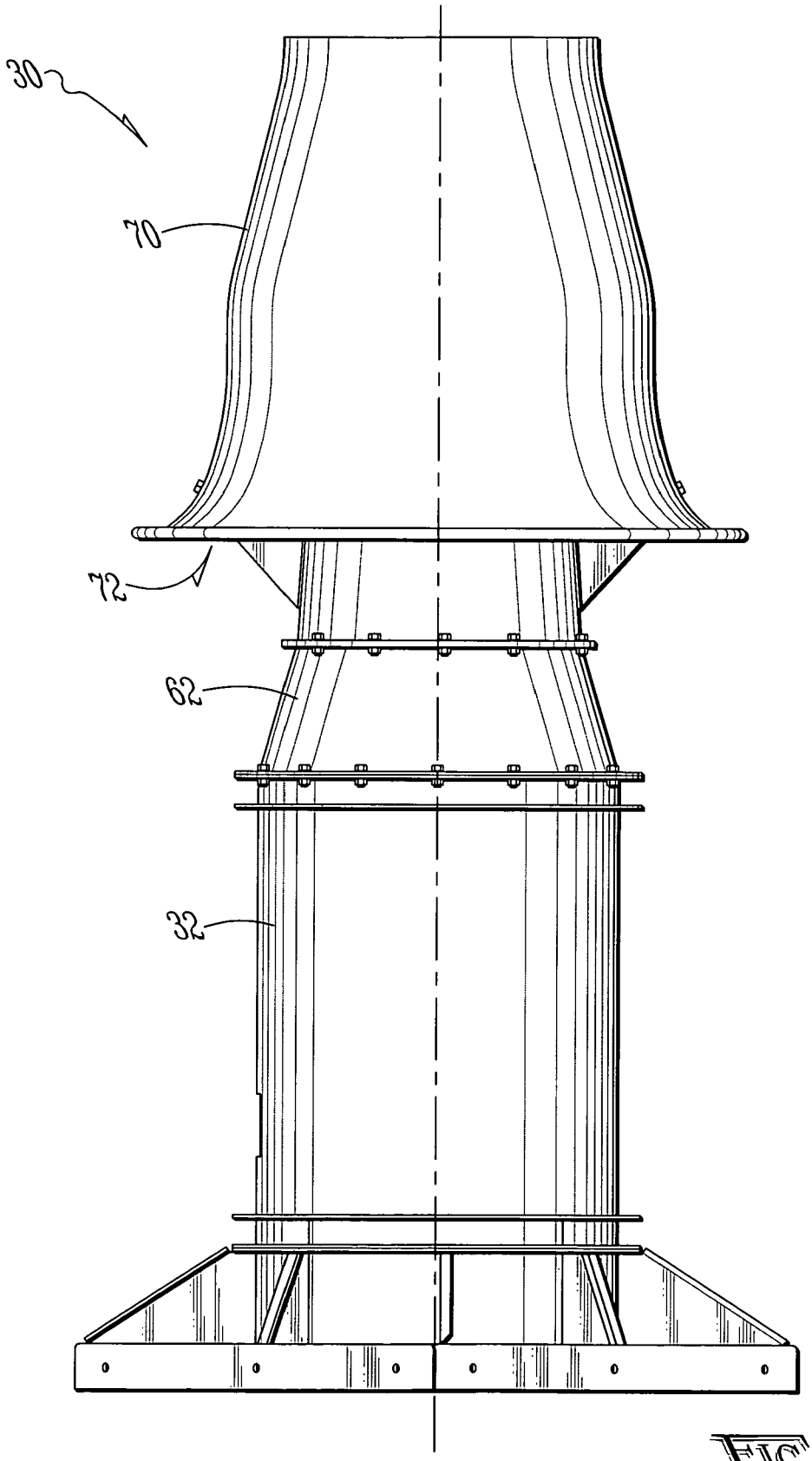
FIG. 7 is a side elevational view thereof.
Figure 8:
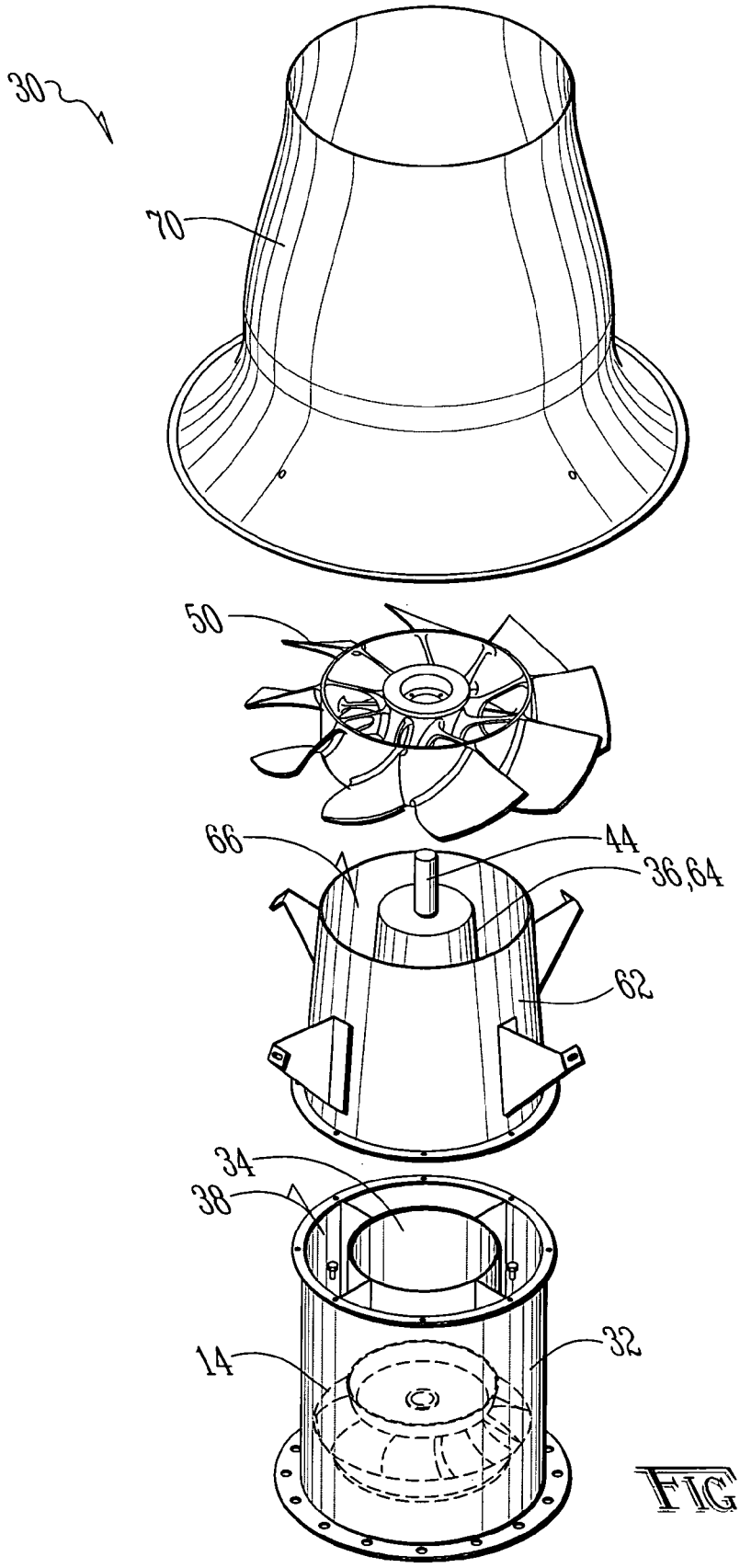
FIG. 8 is an exploded view thereof, with portions shown in hidden lines, other portions removed from the view, and other portions shown in a compressed perspective.

FIGS. 6 through 8 show another embodiment of an exhaust stack system 30 in accordance with the invention. With general reference to FIGS. 6 through 8, this embodiment of an exhaust stack system 30 in accordance with the invention comprises the following. That is, it has a lower outer housing 32 and lower inner housing 34. The lower inner housing 34 may optionally function as a compartment for encasing a second motor 36 (see FIG. 8). However, this second motor 36 can be mounted elsewhere, as on a shelf (this is not shown) completely on the outside of the exhaust stack system 30. Together, the lower inner and outer housings 34 and 32 form an annular intake channel 38 for the inlet-air blower 14's output.

FIG. 6 shows (as does FIG. 1) fixed airfoils 39 airfoils 42 which function to straighten the output of the inlet-air blower 14. The second motor 36 turns a shaft 44 which by means of an optional overhead bearing (not shown) rotates an inventive impeller 50 to be described more particularly below.

This exhaust stack system 30 also has an upper outer housing 62 and upper inner housing 64 for encasing the drive shaft 44 and optional bearing further provide an annular passage 66 for conducting the inlet air flow upwards. The upper outer housing 62 supports a series of brackets 68 on its outside wall for supporting the windband 70 as shown. This windband 70 likewise has an open lower skirt portion 72 for dragging in a dilution (or "rooftop") air flow. This windband 70 extends upwardly to form a discharge nozzle for producing a tall, columnar plume. This windband 70, at about its "waist" closely surrounds the inventive impeller 50.

Figure 9:
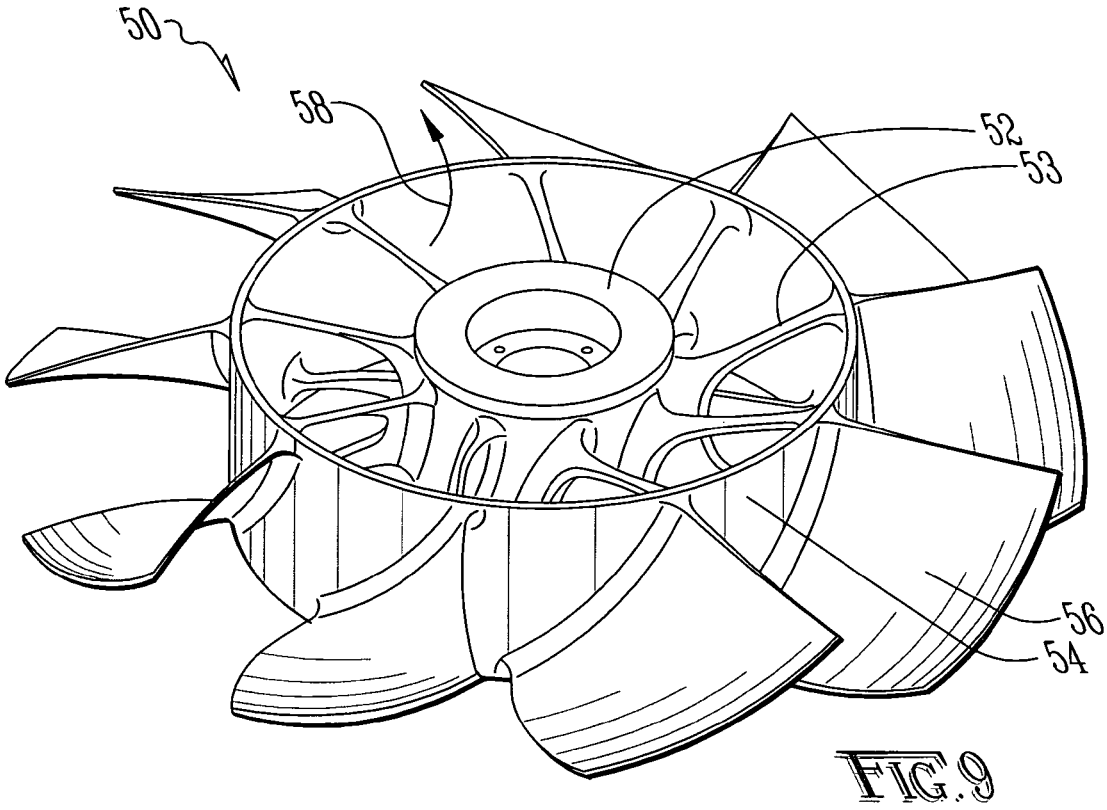
FIG. 9 is an enlarged scale perspective view of the induced air impeller thereof.
Figure 10:
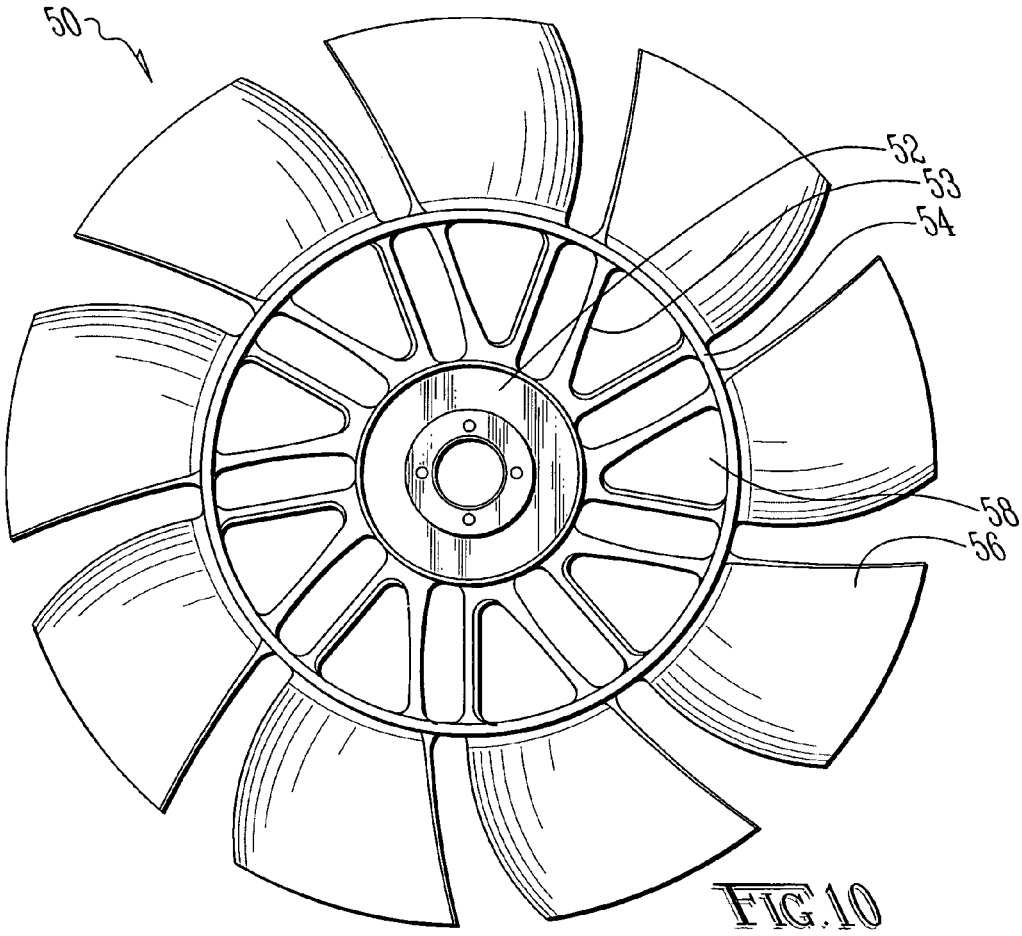
FIG. 10 is a top plan view of FIG. 9.
Figure 11:
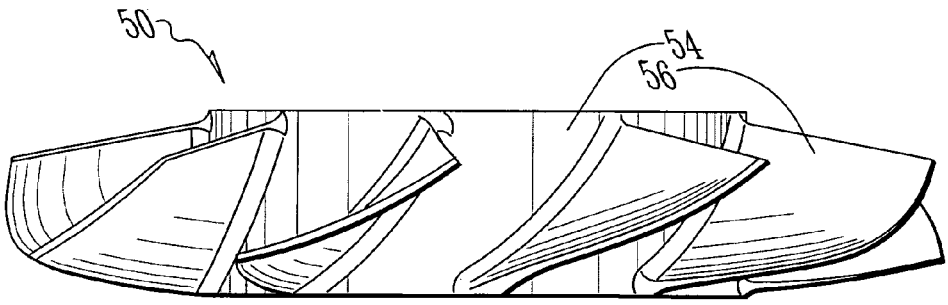
FIG. 11 is a side elevational view thereof.

FIGS. 9 through 11 better show the inventive impeller 50. It generally falls in the classification of axial impellers. It comprises a central hub 52, a series of aerodynamic spokes 53 originating in the hub and extending to terminations in an intermediate ring 54. The intermediate ring 54 supports the origins of a series of angularly-spaced blades 56 which define the "working" impeller portion of this impeller package as a whole. In alternative terminology, this inventive impeller package might be construed as a ribbon impeller, wherein the spokes space away the intermediate ring (eg., ribbon) such that the origins of the blades circuit an orbit spaced away from the hub. The annular region occupied by the spokes defines an inlet flow "bypass" 58.

Given the foregoing, the following inventive objects are achieved. The inlet-air blower 14 can be designed to optimize its function for suctioning out the inlet flow from a converging network of ducts (not shown) having origins in remote diverse intake ports (not shown). Generally, the air-inlet blower 14 is optimized by a package which works best at high pressure duty, but not necessarily high volume duty. Indeed, most conventional air-inlet blowers are either centrifugal flow or mixed flow designs (and FIGS. 1 and 4 through 8 show a mixed flow impeller 14 by way of a non-limiting example).

In contrast, the induced (or "dilution" or else alternatively "rooftop") air impeller 50 is optimized for opposite conditions, or that is, to produce high volume flow in a low pressure environment. In consequence, it is an aspect of the invention to equip an axial flow design for the impeller 50 in service here.

Several advantages are achieved by the foregoing. The inlet-air blower 14 may be separately controlled from the induced-air impeller 50 such that the inlet-air blower 14 might have a horsepower rating of 20 h.p. (ie., horsepower), but variably controlled as circumstances dictate to run at a fraction of its rating but at whatever power level is required to service the demand at hand. When demand is low, the inlet-air blower 14 can run at low power. When demand is highest, the inlet-air blower 14 might be throttled to full power. Regardless, the induced-air impeller 50 will certainly be powered by a much smaller motor, say, for instance, anywhere from down as low to a ½ h.p. to a 3 h.p. motor. That way, a tall, columnar plume can be produced largely by the effects produced by the induced-air impeller 50, and largely independent of the inlet-air blower 14. Thus, a tall, columnar plume can be produced with running the induced-air blower 50 at 3 h.p. while holding the air-inlet blower 14, in low demand times, down to a 2 h.p. load.

Otherwise, if the only driver of the efflux is a lone air-inlet blower 14 of a centrifugal or mixed flow design, it might have to be run at 20 h.p. not because of the demand for suctioning out the inlet air from the converging duct network but because of the need to develop enough efflux velocity and flowrate through the exit nozzle.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. Exhaust apparatus for diluting a forced, primary flow of gases with a secondary flow and expelling the consequential diluted flow; said apparatus comprising:

a passageway for said forced, primary flow; said passageway terminating in an outlet port;

a center body axially extending from the outlet port to a spaced terminal end, said center body being radially contoured in the axial direction from the outlet port toward the terminal end to include a flaring portion, and then a convex transition portion, wherein the outlet port delivers the primary flow to outflow therefrom and be flared out by traversing along the flaring portion; and a collar, axially extending between an input end and a spaced output end, and radially sized to surround the center body and define with said center body an annular flow passage; said collar including an intermediate hoop section sized and disposed to define an annular throat in combination with the center body's convex transition portion;

said collar being disposed such that the input end is aimed to channel the outflow of the primary flow from the outlet port toward said throat, wherein said collar's input end is spaced away from said passageway's outlet port to allow the introduction of the secondary flow to the primary flow such that the consequential diluted flow flows through said throat and is expelled out the output end.

2. The apparatus of claim 1 wherein said passageway comprises an exhaust stack extending into ambient air and said collar comprises a funnel which from the hoop section generally flares out toward the input end as well as tapers in toward the output end, said secondary flow comprising drawn in ambient air.

3. The apparatus of claim 2 further comprising a driven fan downstream from the outlet port for forcing the primary flow, which comprises exhaust gases selected to be diluted.

4. The apparatus of claim 1 wherein said passageway comprises an exhaust stack extending vertically into ambient air and said center body comprises a circumferential seam below the convex transition portion for draining adhering rainwater.

5. The apparatus of claim 1 wherein said center body is furthermore radially contoured such that the convex transition portion is succeeded by a tapering portion in the axial direction from the outlet port toward the terminal end.

6. The apparatus of claim 5 wherein said passageway comprises an exhaust stack projecting into ambient air and said collar tapers toward the output end in spaced correspondence with the center body's tapering portion in order to define an annular nozzle passage sized to forcibly expel the diluted flow.

7. Exhaust apparatus for diluting a forced, primary flow of gases with a secondary flow and expelling the consequential diluted flow; said apparatus comprising:

a passageway for said forced, primary flow; said passageway terminating in an outlet port; and expelling apparatus defining a flow passage that is annularly distributed around an axis;

wherein said expelling apparatus comprises, along an axial sectional cut extending radially-out from said axis:

an inner sidewall axially extending from the outlet port to a spaced terminal end, said inner sidewall being contoured in the axial direction from the outlet port toward the terminal end to include a flaring portion, and then a convex transition portion, wherein the outlet port delivers the primary flow to outflow therefrom and be flared out by traversing along the flaring portion; and an outer sidewall, axially extending between an input end and a spaced output end, and radially-spaced away from the inner sidewall to define with said inner sidewall said flow passage; said inner sidewall including an intermediate section sized and disposed to define a throat in combination with the inner sidewall's convex transition portion;

said outer sidewall being disposed such that the input end is aimed to channel the outflow of the primary flow from the outlet port toward said throat, wherein said outer sidewall's input end is spaced away from said passageway's outlet port to allow the introduction of the secondary flow to the primary flow such that the consequential diluted flow flows through said throat and is expelled out the output end.

8. The apparatus of claim 7 further comprising a center body defining said inner sidewall, a collar defining said outer sidewall, and angularly-distributed brackets mounted at one end to the collar; wherein said flow passage is so annularly distributed as to be substantially annular.

9. The apparatus of claim 7 wherein said passageway comprises an exhaust stack extending into ambient air and said outer sidewall comprises a funnel-form which from the intermediate section generally flares out toward the input end as well as tapers in toward the output end, said secondary flow comprising drawn in ambient air.

10. The apparatus of claim 9 further comprising a driven fan downstream from the outlet port for forcing the primary flow, which comprises exhaust gases selected to be diluted.

11. The apparatus of claim 7 wherein said inner sidewall body is furthermore contoured such that the convex transition portion is succeeded by a tapering portion in the axial direction from the outlet port toward the terminal end.

12. The apparatus of claim 11 wherein said passageway comprises an exhaust stack projecting into ambient air and said outer sidewall tapers toward the output end in spaced correspondence with the inner sidewall's tapering portion in order to define a nozzle-form sized to forcibly expel the diluted flow.

* * * * *